US010411426B2

(12) United States Patent
Bae et al.

(10) Patent No.: US 10,411,426 B2
(45) Date of Patent: Sep. 10, 2019

(54) CONNECTING DEVICE AND METHOD FOR RECOGNIZING DEVICE

(71) Applicant: Samsung Electronics Co., Ltd., Gyeonggi-do (KR)

(72) Inventors: Han Geun Bae, Gyeonggi-do (KR); Cheol Ho Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 256 days.

(21) Appl. No.: 15/220,562

(22) Filed: Jul. 27, 2016

(65) Prior Publication Data

US 2017/0033513 A1 Feb. 2, 2017

(30) Foreign Application Priority Data

Jul. 27, 2015 (KR) ..... 10-2015-0106133

(51) Int. Cl.
*H01R 31/06* (2006.01)
*H01R 13/66* (2006.01)
*H01R 24/60* (2011.01)

(52) U.S. Cl.
CPC ..... *H01R 31/065* (2013.01); *H01R 13/6616* (2013.01); *H01R 24/60* (2013.01)

(58) Field of Classification Search
CPC ... H01R 31/065; H01R 13/6616; H01R 24/60
See application file for complete search history.

(56) References Cited

U.S. PATENT DOCUMENTS 7,268,561 B2 9/2007 Zhu
8,065,446 B2 * 11/2011 Kang ..... G06F 13/387 710/15
2003/0030412 A1 * 2/2003 Matsuda ..... G06F 1/263 320/127
2006/0075152 A1 4/2006 Zhu
2012/0030485 A1 * 2/2012 Kawano ..... G06F 1/266 713/300
2016/0062935 A1 * 3/2016 Talmola ..... G06F 1/266 710/306
2016/0285757 A1 * 9/2016 Srivastava ..... H04L 12/10

FOREIGN PATENT DOCUMENTS

JP 2003-308941 A 10/2003

* cited by examiner

*Primary Examiner* — Tim T Vo
*Assistant Examiner* — Herve Iradukunda
(74) *Attorney, Agent, or Firm* — Cha & Reiter, LLC.

(57) ABSTRACT

A connecting device is provided that connects first and second external electronic devices with different types of interfaces. The connecting device includes a first connector corresponding to a first type of connection configuration of a first external electronic device, a second connector corresponding to a second type of connection configuration of a second external electronic device, a plurality of signal lines connecting at least a portion of a row of pins included in the first connector to at least a portion of a row of pins included in the second connector, and a switching circuit connected to a recognition pin of the first connector. The switching circuit connects either a first resistor or a second resistor to the recognition pin included in the first connector, according to a control of an identification pin included in the second connector.

19 Claims, 14 Drawing Sheets

CONNECTING DEVICE AND METHOD FOR RECOGNIZING DEVICE

CLAIM OF PRIORITY

This application claims the benefit of priority under 35 U.S.C. § 119(a) from a Korean patent application filed on Jul. 27, 2015 in the Korean Intellectual Property Office and assigned Serial number 10-2015-0106133, the entire disclosure of which is hereby incorporated by reference in its entirely.

BACKGROUND

Field of the Disclosure

The present disclosure relates to a connecting device that connects other electronic devices together, and a method for recognizing the connecting device by each of the electronic devices.

Description of the Related Art

An electronic device such as a smartphone, a tablet, or the like may be connected to various external devices. When the connection between the devices is a wired connection, the electronic device may be connected to an accessory device or USB storage device to charge a battery of the electronic device or to exchange various data signals therewith.

A connecting device such as a cable or a gender changer may be used to connect the electronic device to an external device. The connecting device may be used to match corresponding pins of connectors that have different standards.

A connecting device according to the related art is capable of operating in both a host mode and a device mode (on-the-go (OTG) type). However, the connecting device may support only one of the host mode and the device mode because of a fixed function when the connecting device connects an electronic device (e.g., a smartphone or a table PC), which supports USB Type-C, and an external electronic device mounted on a connector of USB Type (e.g., USB Type-A, USB Type-B, USB Type micro-A, USB Type micro-B, or the like) that is different from the USB Type-C. Thus, there is a need to provide a connecting device that permits connections of multiple electronic devices mounted on different connectors without limit.

SUMMARY

Aspects of the present disclosure address at least some of the above-mentioned problems and/or disadvantages and provide at least some of the advantages described below. Accordingly, an aspect of the present disclosure is to provide a connecting device that allows a connection with a first electronic device mounted on a first type of connector (e.g., USB Type-C) to be connected with a second electronic device mounted on a second type of connector (e.g., USB Type-A, USB Type-B, USB Type micro-A, USB Type micro-B, or the like) without limit.

In accordance with an aspect of the present disclosure, a connecting device is provided. The connecting device may include a first connector corresponding to a first type of connection, a second connector corresponding to a second type of connection, signal lines connecting some of a row of pins included in the first connector to a row of pins included in the second connector, and a switching circuit connected to a recognition pin of the first connector. The switching circuit connects one of a first resistor and a second resistor to the recognition pin included in the first connector according to a control of an identification pin included in the second connector.

More particularly, in an embodiment of the disclosure, a connecting device includes: a first connector corresponding to a first type of connection configuration of a first external electronic device; a second connector corresponding to a second type of connection configuration of a second external electronic device, in which the first type of connection configuration is different from the second type of connection configuration; a plurality of signal lines connecting at least a portion of a row of pins included in the first connector to at least a portion of a row of pins included in the second connector; and a switching circuit connected to a recognition pin of the first connector, wherein the switching circuit electrically connects one of a first resistor and a second resistor to the recognition pin included in the first connector according to a control of an identification (ID) pin included in the second connector.

A method of connecting a first external electronic device to a second external electronic device by a connecting device includes the operations of: providing the connecting device having a first connector corresponding to a first type of connection configuration of a first external electronic device, and a second connector corresponding to a second type of connection configuration of a second external electronic device, connecting at least a portion of a row of pins included in the first connector to at least a portion of a row of pins included in the second connector by a plurality of signal lines, providing a switching circuit that connects one of a first resistor and a second resistor to the recognition pin included in the first connector according to a control of an identification (ID) pin included in the second connector, wherein the first type of connection configuration is different from the second type of connection configuration.

Other aspects, advantages, and salient features of the disclosure will become better appreciated by those of ordinary skill in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be better appreciated by a person of ordinary skill in the art from the following description taken in conjunction with the accompanying drawings, in which.

Throughout the drawings, it should be noted that like reference numbers are used to depict the same or similar elements, features, and structures.

DETAILED DESCRIPTION

Figure 1:
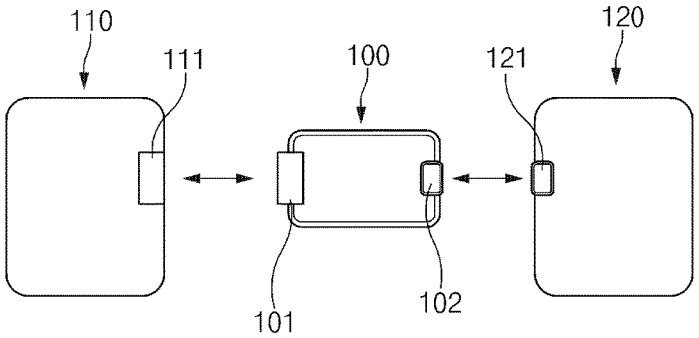
FIG. 1 shows one possible view of a connection between first and second electronic devices via a connecting device, according to various embodiments of the present disclosure.

Hereinafter, various embodiments of the present disclosure will be described with reference to the accompanying drawings. Accordingly, those of ordinary skill in the art will recognize that many modifications, and/or alternative arrangements of the various embodiments described herein can be made without departing from the scope of the appended claims and spirit of the present disclosure. With regard to description of drawings, similar components may be identified by similar reference numerals.

In the present disclosure, the expressions "have", "may have", "include" and "comprise", or "may include" and "may comprise" as used herein indicate existence of corresponding features (for example, elements such as numeric values, functions, operations, or components) but do not exclude the presence of additional features.

In the present disclosure, the expressions "A or B", "at least one of A or/and B", or "one or more of A or/and B", and the like as used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like as used herein may refer to various elements of various embodiments of the present disclosure, but do not limit the elements to any particular order or sequence as shown and described. For example, such terms are used only to distinguish an element from another element and do not limit the order and/or priority of the elements. For example, a first user device and a second user device may represent different user devices irrespective of their sequence or importance in any description herein. For example, without departing the scope of the present disclosure, a first element may be referred to as a second element, and similarly, a second element may be referred to as a first element.

It will be understood that when an element (for example, a first element) is referred to as being "(operatively or communicatively) coupled with/to" or "connected to" another element (for example, a second element), such an element can be directly coupled with/to or connected to the other element, or an intervening element (for example, a third element) may be present. In contrast, when an element (for example, a first element) is referred to as being "directly coupled with/to" or "directly connected to" another element (for example, a second element), a person of ordinary skill in the art should be understand that there are no intervening elements (for example, a third element).

Depending on the situation, the expression "configured to" as used herein may be used as, for example, the expression "suitable for", "designed to", "adapted to", or "made to". The term "configured to (or set to)" does not refer only "specifically designed to" in hardware. Instead, the expression "a device configured to" may refer that the device that operates together with another device or other components. A Central Processing Unit (CPU), for example, a "processor configured to (or set to) perform A, B, and C" may refer to a dedicated processor (for example, an embedded processor) for performing a corresponding operation or a generic-purpose processor (for example, a central processing unit (CPU) or an application processor) including integrated circuitry which may perform corresponding operations by executing one or more software programs which are stored in a memory device.

Terms used in this specification are provided for the illustration of certain specified embodiments of the present disclosure, and do limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary by a person of ordinary skill in the relevant related art and not in an idealized or overly formal detect unless expressly so defined herein in various embodiments of the present disclosure. In some cases, even if terms are defined in the specification, they may not be interpreted to exclude embodiments of the present disclosure.

An electronic device as discussed herein according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), MP3 players, mobile medical devices, cameras, and wearable devices. According to various embodiments of the present disclosure, the wearable devices may include accessories (for example, watches, rings, bracelets, ankle bracelets, glasses, contact lenses, or head-mounted devices (HMDs)), cloth-integrated types (for example, electronic clothes), body-attached types (for example, skin pads or tattoos), or implantable types (for example, implantable circuits).

In some embodiments of the present disclosure, the electronic device may be one or more home appliances. The home appliances may include, for example, at least one of a digital video disk (DVD) player, an audio, a refrigerator, a freezer, an air conditioner, a cleaner, an oven, a microwave oven, a washing machine, an air cleaner, a set-top box, a home automation control panel, a security control panel, a TV box (for example, Samsung HomeSync™, Apple TV™, or Google TV™), a game console (for example, Xbox™ or PlayStation™), an electronic dictionary, an electronic key, a camcorder, or an electronic panel.

In another embodiment of the present disclosure, the electronic device may include at least one of various medical devices (for example, various portable medical measurement devices (including but in no way limited to a blood glucose meter, a heart rate measuring device, a blood pressure measuring device, and a body temperature measuring device), a magnetic resonance angiography (MRA), a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (for example, a navigation device for vessels and a gyro compass), avionics, a security device, a vehicular head unit, an industrial or home robot, an Automatic Teller Machine (ATM), a point of sales (POS) device in a store, or an Internet of Things (for example, a light bulb, various sensors, an electricity meter or a gas meter, a spring cooler device, a fire alarm device, a thermostat, an electric pole, a toaster, a sporting apparatus, a hot water tank, a heater, and a boiler).

According to some embodiments of the present disclosure, the electronic device may include at least one of a furniture or a part of a building/structure, an electronic board, an electronic signature receiving device, a projector, or various measurement devices (for example, a water service, electricity, gas, or electric wave measuring device), just to name some additional non-limiting possibilities. In various embodiments of the present disclosure, the electronic device may be one, or a combination of, the aforementioned devices. The electronic device according to some embodiments of the present disclosure may be a flexible electronic device. Further, the electronic device according to an embodiment of the present disclosure is not limited to the aforementioned devices, but may include new electronic devices produced due to the development of technologies.

Hereinafter, electronic devices according to an embodiment of the present disclosure will be described with reference to the accompanying drawings. The term "user" used herein may refer to a person who operates an electronic device, or may refer to a device (for example, an artificial electronic device) that operates an electronic device.

With reference to the drawings, FIG. 1 shows a connection between a first electronic device and a second electronic device by using a connecting device, according to various embodiments of the present disclosure.

Referring now to FIG. 1, a connecting device 100 according to the present disclosure may connect a first electronic device 110 to a second electronic device 120, even though the first device and second device may have different interface types. The first electronic device 110 and the second electronic device 120 may exchange data through the connecting device 100.

According to various embodiments of the present disclosure, one of the first electronic device 110 and the second electronic device 120 may operate in a 'host mode', and the other electronic thereof may operate in a 'device mode'. For example, in the case where the first electronic device 110 operates in the host mode, the second electronic device 120 may operate in the device mode. In contrast, in the case where the first electronic device 110 operates in the device mode, the second electronic device 120 may operate in the host mode. A device (hereinafter referred to as "host mode device"), which operates in the host mode, may supply electric power to a device (hereinafter referred to as "device mode device") that operates in the device mode and may store or read data in or from the device mode device.

According to various embodiments, of the present disclosure an operating mode of each of the first and second electronic devices 110 and 120 may be set according to a type thereof. For example, a laptop PC may always operate in the host mode, and a USB memory device or printer device may always operate in the device mode. As another example, an electronic device such as a smartphone or a tablet may be set to select one of the host mode or to the device mode based on a type of a counterpart electronic device connected thereto (the OTG mode).

With continued reference to FIG. 1, the first electronic device 110 is capable of being connected to an external device through a connector 111 of a first type (hereinafter referred to as "first type connector"), and may comprise a device such as a smartphone or a tablet. For example, the first type connector 111 may be a socket-type connector (or receptacle) of USB 3.1 Type-C.

According to various embodiments of the present disclosure, the first electronic device 110 may recognize a type of the second electronic device 120 (the device mode device or the host mode device) connected thereto, by using a designated pin (e.g., a CC1 pin). The first electronic device 110 may be set to select one of the host mode and the device mode based on the recognized type of the second electronic device 120. The second electronic device 120 may include a connector or a receptacle.

According to an embodiment of the present disclosure, in the case where the first electronic device 110 recognizes a first resistor (e.g., based on a value of the resistance, for example, about 5.1 kΩ) through a recognition pin (e.g., the CC1 pin) included in the first type connector 111, the first electronic device 110 may determine that the mode of the second electronic device 120 is the device mode device. In this case, the first electronic device 110 may operate in the host mode. In the host mode, the first electronic device 110 may supply electric power to the second electronic device 120 through the connecting device 100. Furthermore, the first electronic device 110 may control the second electronic device 120 to read data stored in the second electronic device 120 or write data in the second electronic device 120.

According to another embodiment, of the present disclosure in the case where the first electronic device 110 recognizes a second resistor (for example, recognizing a resistance of about 22 kΩ) through the recognition pin (e.g., the CC1 pin) included in the first type connector 111, the first electronic device 110 may determine that the mode of the second electronic device 120 is the host mode device. In this case, the first electronic device 110 may operate in the device mode. In the device mode, the first electronic device 110 may be supplied with electric power from the second electronic device 120 via the connecting device 111. Under control of the second electronic device 120, the first electronic device 110 may store data or provide data to the second electronic device 120.

The second electronic device 120 may be a device that is connected to the outside through a connector 121 of a second type (hereinafter referred to as "second type connector"). The second electronic device 120 may be a device mode device such as a USB storage device, a printer, or the like or may be a host mode device such as a desktop PC, a laptop PC, a television (TV), or the like. In various embodiments, the second type connector 121 may be a connector of an insertion-type plug form, which supports USB 2.0 (Type-A, Type-B, Type micro-A, and Type micro-B).

In the case where the second electronic device 120 is a device mode device, the second electronic device 120 may be supplied with electric power from the first electronic device 110 via the connecting device 100 and may store data or provide data to the first electronic device 110, under control of the first electronic device 110.

In contrast, in the case where the second electronic device 120 is a host mode device, the second electronic device 120 may supply electric power to the first electronic device 110 via the connecting device 100 and may read or store data from or in the first electronic device 110.

The connecting device 100 may include a first connector 101 connected to the first electronic device 110 and a second connector 102 connected to the second electronic device 120.

As shown in FIG. 1, the first connector 101 may be connected to the first type connector 111 mounted on the first electronic device 110. The first connector 101 may have a form corresponding to the first type connector 111. For example, the first type connector 101 may be of an insertion-type plug form based on the USB type-C, and the first type connector 111 may be a connector of a socket form (or receptacle) based on the USB type-C.

According to various embodiments of the present disclosure, each of the first connector 101 and the first type connector 111 may be a socket-type (or receptacle) connector. In this case, the first connector 101 and the first type connector 111 may be connected through a cable of which opposite ends have an insertion-type plug form.

According to various embodiments of the present disclosure, if the first connector 101 and the first type connector 111 correspond to the USB 3.1 Type-C, the first connector 101 and the second type connector 111 may include a first sub-pin row and a second sub-pin row that is symmetrical to the first sub-pin row. The first sub-pin row may have an arrangement of pins that are symmetrical to those of the second sub-pin row.

Figure 2:
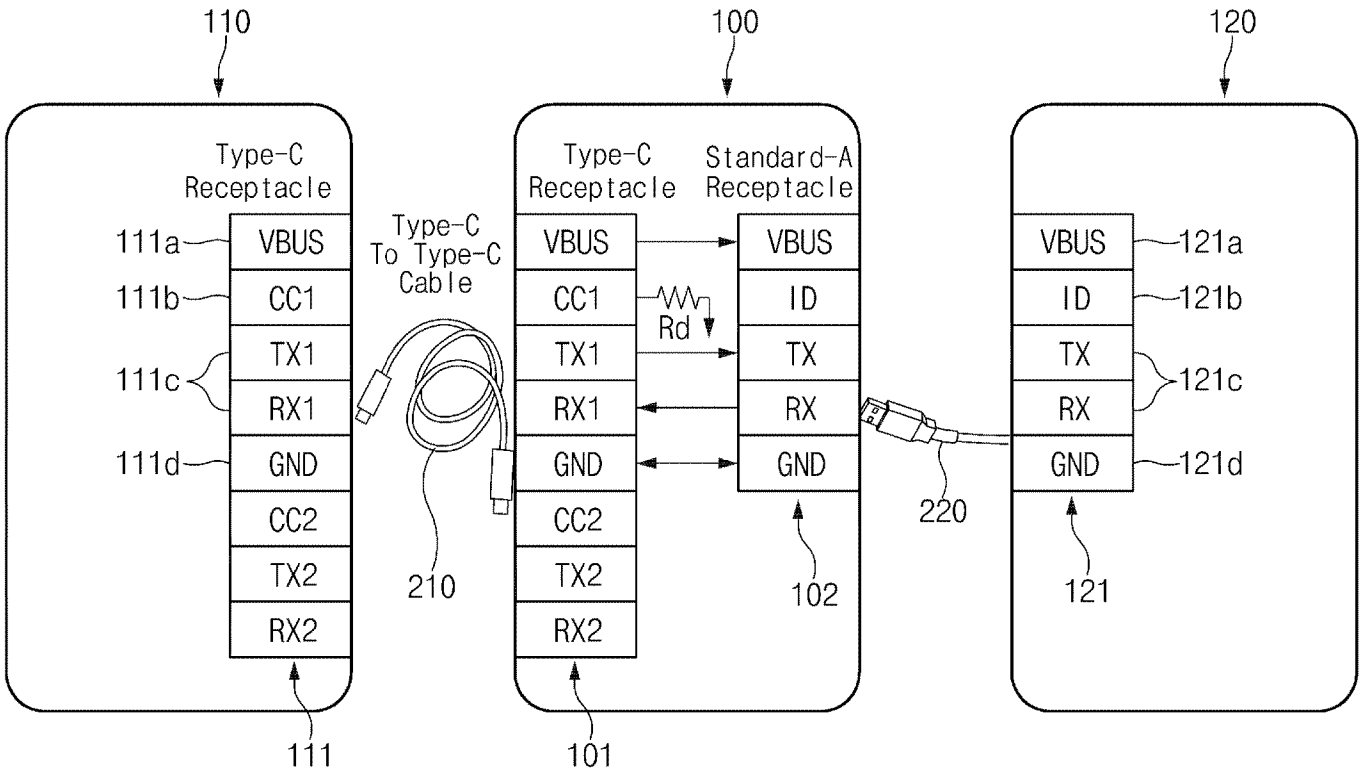
FIG. 2 is a configuration diagram illustrating a connection when a second electronic device is a 'device mode' device, according to various embodiments of the present disclosure.

According to various embodiments of the present disclosure, as shown in FIG. 2, the connecting device 100 may include a switch circuit connected to the recognition pin (e.g., the CC1 pin) of the first connector 101. The switching circuit may connect one of a first resistor and a second resistor to the recognition pin based on a type of the second electronic device 120 (a host mode device or a device mode device). The first electronic device 110 may recognize the first resistor or the second resistor to determine a type of the second electronic device 120. Additional information about the switching circuit will be given with reference to FIGS. 5 to 10.

The second connector 102 of the connecting device 100 may be connected to the second type connector 121 mounted on the second electronic device 120. The second connector 102 may have a form corresponding to the second type connector 121.

For example, in the case where the second electronic device 120 is a device mode device (e.g., a USB storage device or a printer), the second type connector 121 may be a connector of an insertion-type plug form based on the USB Type-A, and the second connector 102 may be a connector of a socket-type (or receptacle) form based on the USB type-C.

For another example, in the case where the second electronic device 120 is a host mode device (e.g., a desktop PC or a laptop PC), the second type connector 121 may be a connector of a socket-type (or receptacle) form based on the USB Type-A, and the second connector 102 of connecting device 100 may be a connector of an insertion-type plug form based on the USB type-A.

However, the claims are not limited to the aforementioned embodiments. For example, each of the second connector 102 and the second type connector 121 may be of a socket-type (or receptacle) form and may be connected through a separate cable of which opposite ends are of an insertion-type plug form. Alternatively, each of the second connector 102 and the second type connector 121 may be of an insertion-type plug form and may be connected through a separate cable of which opposite ends are of a socket-type (or receptacle) form. In various embodiments, the second connector 102 may be implemented to have both the socket-type (or receptacle) form and the insertion-type plug form.

According to various embodiments of the present disclosure, the connecting device 100 may have a circuit board (e.g., a PCB) in the interior thereof. The circuit board (not shown) may include signal lines, which connect pins of the first connector 101 with pins of the second connector 101, and a switching circuit.

According to various embodiments of the present disclosure, the connecting device 100 may include a housing for mounting the circuit board and internal elements. The exterior of the connecting device 100 may be formed such that the housing is partially exposed. or a separate case is attached to the housing.

FIG. 2 is a configuration diagram illustrating a connection when the second electronic device is a device mode device, according to various embodiments of the present disclosure. Some pins are illustrated in FIG. 2. However, the present claims are not limited to the embodiments shown and described herein.

Referring now to FIG. 2, the connecting device 100 may connect the first electronic device 110 to the second electronic device 120.

The first connector 101 may be connected to the first type connector 111 mounted on the first electronic device 110 directly or through a separate cable 210. Below, embodiments will be described under the condition that the first connector 101 and the first type connector 111 are of the USB Type-C. However, the appended claims are not limited to the embodiments shown and described herein.

The second connector 102 may be electrically connected to the second type connector 121 mounted on the second electronic device 120 directly, or through a separate cable 220. Below, an embodiment will be described under the condition that the second connector 102 and the second type connector 121 are of the USB Type-A. However, the appended claims are not limited to the embodiments shown and described herein.

In the case where the second electronic device 120 is a device mode device, the first electronic device 110 may operate in the host mode, and the second electronic device 120 may operate in the device mode.

An identification pin (e.g., an ID pin) 121*b* may be connected to a ground if the second electronic device 120 is a device mode device. A switching circuit in the connecting device 100 may connect a first resistor Rd (e.g., 5.1 kΩ) to a recognition pin 111*b* of the first electronic device 110 by using a voltage value of the identification pin 121*b*. According to various embodiments of the disclosure, the first resistor Rd may be a pull-down resistor of which one end is connected to the ground.

In the case where the first electronic device 110 recognizes the first resistor Rd by its value (e.g., 5.1 kΩ) through the recognition pin (e.g., the CC1 pin), the first electronic device 110 may determine that the second electronic device 120 is a device mode device. In this case, the first electronic device 110 may operate in the host mode.

A power pin (e.g., a VBUS pin) 111*a* of the first electronic device 110 may be connected to a power pin 121*a* of the second electronic device 120 through the connecting device 100. The first electronic device 110 may supply electric power to the second electronic device 120.

Data pins 111*c* (e.g., TX1 and RX1) of the first electronic device 110 may be connected to data pins 121*c* (e.g., TX and RX) of the second electronic device 120 through the connecting device 100. The first electronic device 110 may read or store data from or in the second electronic device 120 through the data pins 111*c* (e.g., TX1 and RX1).

Figure 3:
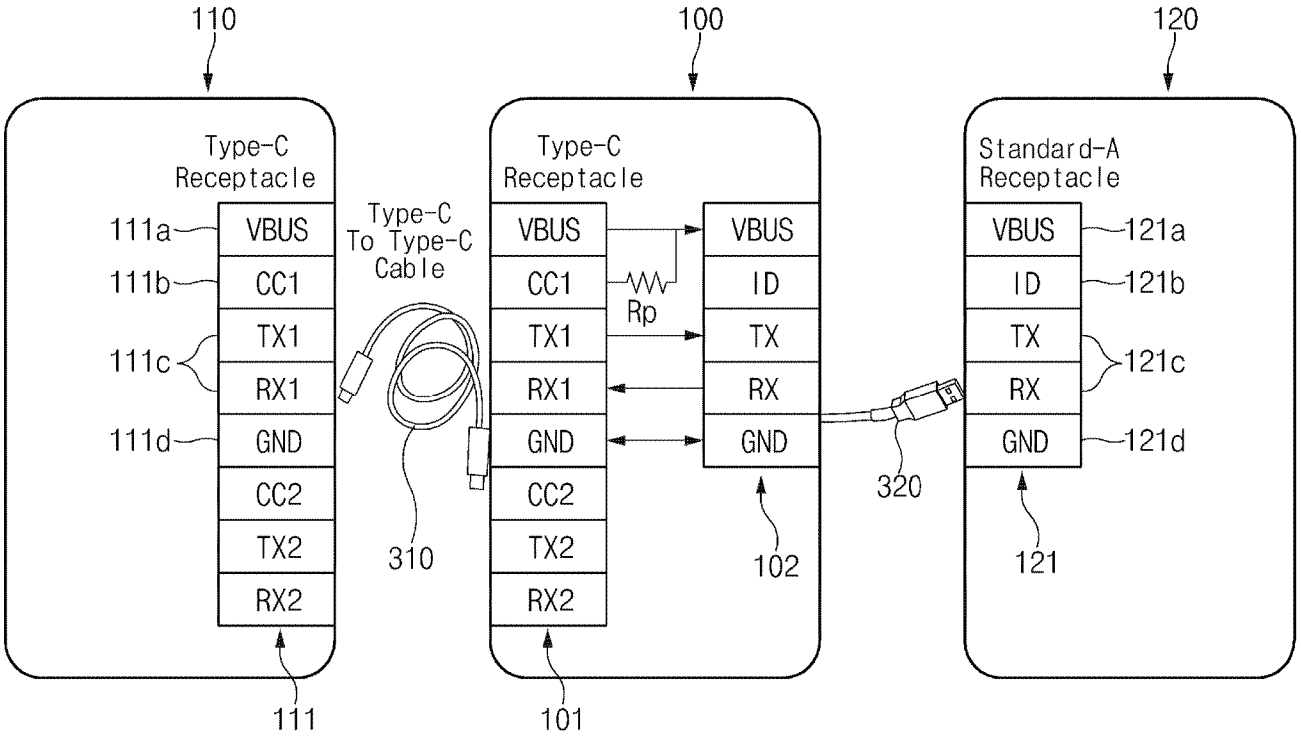
FIG. 3 is a configuration diagram illustrating a connection when a second electronic device is a host mode device, according to various embodiments of the present disclosure.

FIG. 3 is a configuration diagram illustrating a connection when the second electronic device is a host mode device, according to various embodiments. Some pins are illustrated in FIG. 3. However, the appended claims are not limited to embodiments shown and described herein.

Referring now to FIG. 3, the connecting device 100 may connect the first electronic device 110 and the second electronic device 120. The first connector 101 may be connected to the first type connector 111 mounted on the first electronic device 110 directly or through a separate cable 310. The second connector 102 may be connected to the second type connector 121 mounted on the second electronic device 120 directly or through another separate cable 320.

In the case where the second electronic device 120 is a host mode device, the first electronic device 110 may operate in the device mode, and the second electronic device 120 may operate in the host mode.

With reference to the second electronic device 120, the identification pin (e.g., the ID pin) 121*b* may remain in an open state if the second electronic device 120 is a host mode device. The switching circuit in the connecting device 100 may connect a second resistor Rp (e.g., 22 kΩ) to the recognition pin 111*b* of the first electronic device 110 by using a voltage value of the identification pin 121*b*. According to various embodiments of the present disclosure, the second resistor Rd may be a pull-up resistor of which one end is electrically connected to a power pin.

In the case where the first electronic device 110 recognizes the second resistor Rp (e.g., 22 kΩ) through the recognition pin (e.g., the CC1 pin), the first electronic device 110 may determine that the second electronic device 120 is a host mode device. In this case, the first electronic device 110 may operate in the device mode.

With reference to the first electronic device 110, the power pin (e.g., the VBUS pin) 111*a* may be connected to the power pin 121*a* of the second electronic device 120 through the connecting device 100. The first electronic device 110 may be supplied with electric power from the second electronic device 120 via the connecting member.

With continued reference to FIG. 3, the data pins 111*c* (e.g., TX1 and RX1) of the first electronic device 110 may be connected to the data pins 121*c* (e.g., TX and RX) of the second electronic device 120 through the connecting device 100. The second electronic device 120 may read or store data from, or in, the first electronic device 110 through the data pins 121*c* (e.g., TX1 and RX1).

Figure 4:
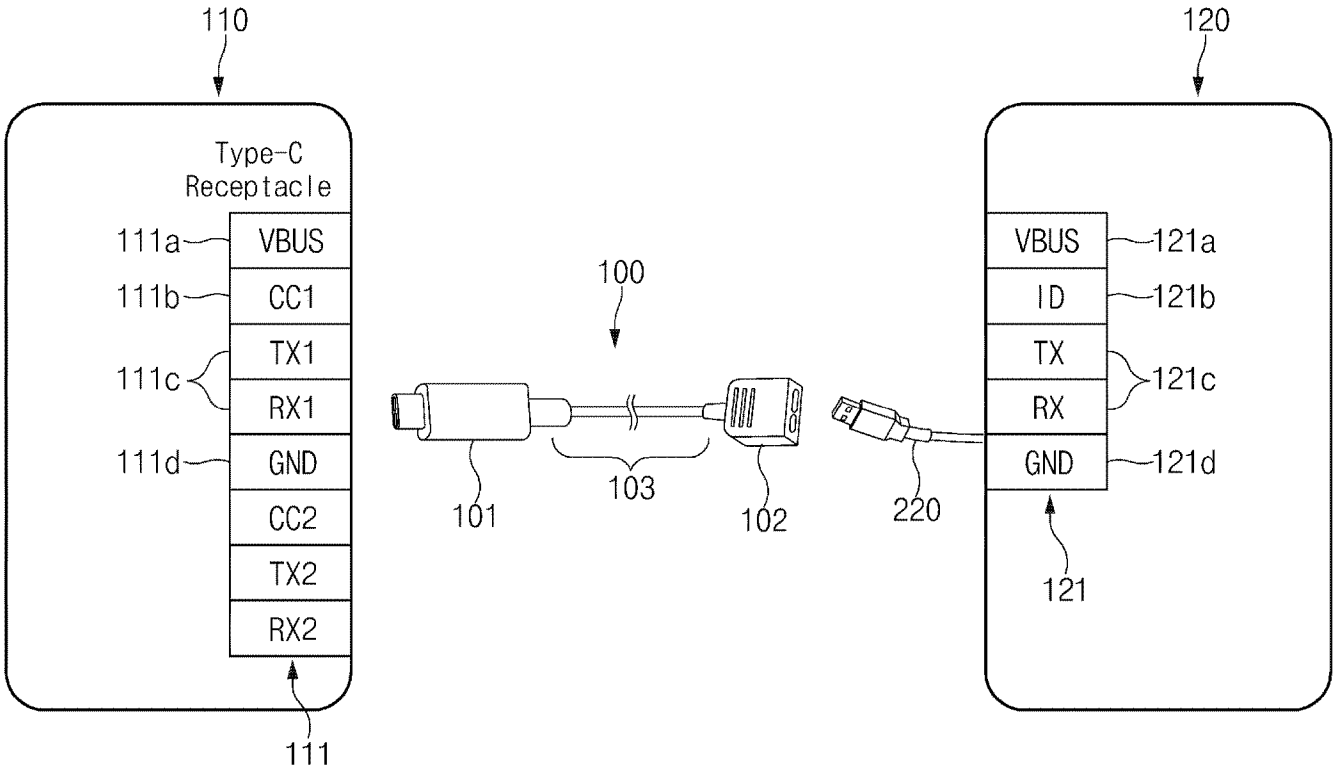
FIG. 4 illustrates a connecting device including a cable part that provides a connection between two electronic devices, according to various embodiments of the present disclosure.

FIG. 4 illustrates a connecting device 100 including a cable part 103, according to various embodiments of the present disclosure.

Referring now to FIG. 4, the connecting device 100 may include the first connector 101, the second connector 102, and a cable part 103.

The first connector 101 of the connecting device 100 may be connected to the first type connector 111 mounted on the first electronic device 110. A first end of the first connector 101 may be formed in the shape of a plug that is insertable into the first type connector 111 of a socket-type (or receptacle) form. A second end of the first connector 101 may be connected to the second connector 102 through the cable part 103.

According to various embodiments of the present disclosure, the connecting device 100 may include a switching circuit, which is connected to the recognition pin (e.g., the CC1 pin) of the first electronic device 100, in the vicinity of the first connector 101. The switching circuit may include the first resistor Rd (e.g., 5.1 kΩ), the second resistor Rp (e.g., 22 kΩ), and at least one switch. The switching circuit may electrically connect either one of the first resistor Rd (e.g., 5.1 kΩ) or the second resistor Rp (e.g., 22 kΩ) to the recognition pin (e.g., the CC1 pin) 111*b* of the first electronic device 110, based on a value of a voltage applied to the identification pin 121*b* (e.g., the ID pin) of the second electronic device 120. The first electronic device 110 may determine whether the second electronic device 120 is a host mode device or a device mode device, based on a resistance value recognized through the recognition pin (e.g., the CC1 pin) 111*b*. The first electronic device 110 may determine whether to operate in the device mode or the host mode, based on the determination result.

The second connector 102 may be connected to the second type connector 121 mounted on the second electronic device 120. A first end of the second connector 102 may be formed in the shape of a socket (or receptacle) into which the first type connector 121 of a plug form is inserted. A second end of the second connector 102 may be connected to the first connector 101 through the cable part 103.

The cable part 103 may electrically connect the first connector 102 and the second connector 103. A length of the cable part 103 may be variable. According to various embodiments, the cable part 103 may include signal lines corresponding to some of pins included in the first connector 101. For example, in the case where the first connector 101 is a connector according to the USB 3.1 Type-C, the cable part 103 may include signal lines corresponding to one pin row (or some of pins in one pin row) of a first pin row and a second pin row of the first connector 101.

Figure 5:
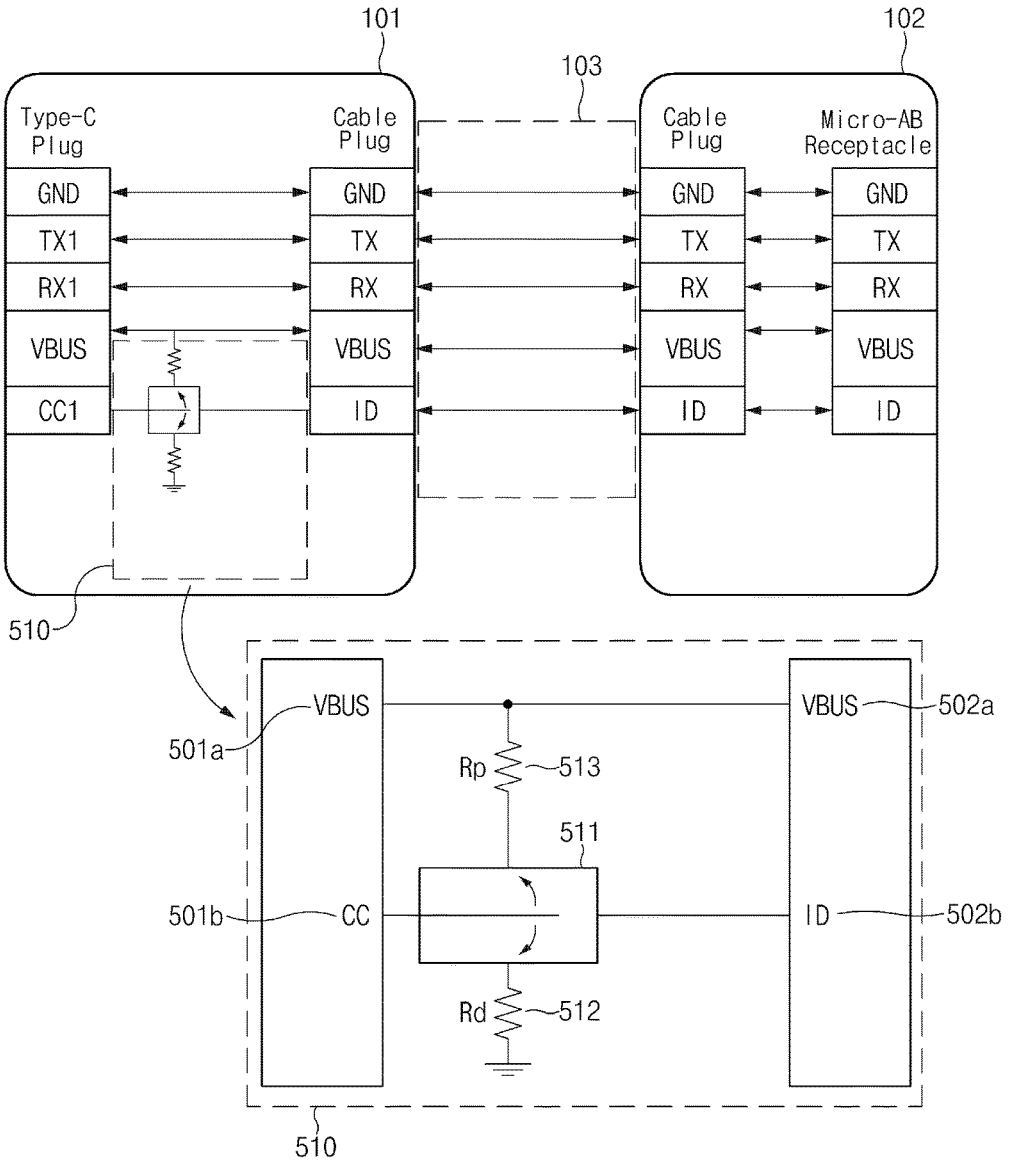
FIG. 5 is a view illustrating a configuration of a switching circuit included in a connecting device, according to various embodiments of the present disclosure.

FIG. 5 is a view illustrating a configuration of a switching circuit included in the connecting device, according to various embodiments of the present disclosure. In FIG. 5, an embodiment is exemplified as the cable part 103 is included. However, embodiments are not limited thereto. Some pins of the first and second connectors 101 and 102 are illustrated in FIG. 5. However, the appended claims are not limited to the embodiments shown and described herein.

Referring now to FIG. 5, the connecting device 100 may include the first connector 101, the second connector 102, and the cable part 103. The connecting device 100 may include a switching circuit 510, which is connected to a recognition pin (e.g., the CC1 pin), in the first connector 101.

The switching circuit 510 may include a switching part 511, a pull-down resistor (Rd) 512, and a pull-up resistor (Rp) 513.

The switching part 511 may be controlled by a voltage on the identification pin (e.g., the ID pin) 502*b*. The identification pin (e.g., the ID pin) 502*b* may be connected to an identification pin (e.g., an ID pin) of the second electronic device 120. The identification pin (e.g., the ID pin) 502*b* may remain at a ground state if the second electronic device 120 is a device mode device and at an open state when the second electronic device 120 is a host mode device.

The pull-down resistor (Rd) 512 may be connected between the switching part 511 and the ground. If the second electronic device 120 is a device mode device, the pull-down resistor (Rd) 512 may be connected to the recognition pin (e.g., the CC1 pin) 501*b* through the switching part 511.

The pull-up resistor (Rp) 513 may be connected between the switching part 511 and the power pin VBUS 502*a*. If the second electronic device 120 is a host mode device, the pull-up resistor (Rp) 513 may be connected to the recognition pin (e.g., the CC1 pin) 501*b* through the switching part 511.

Figure 6:
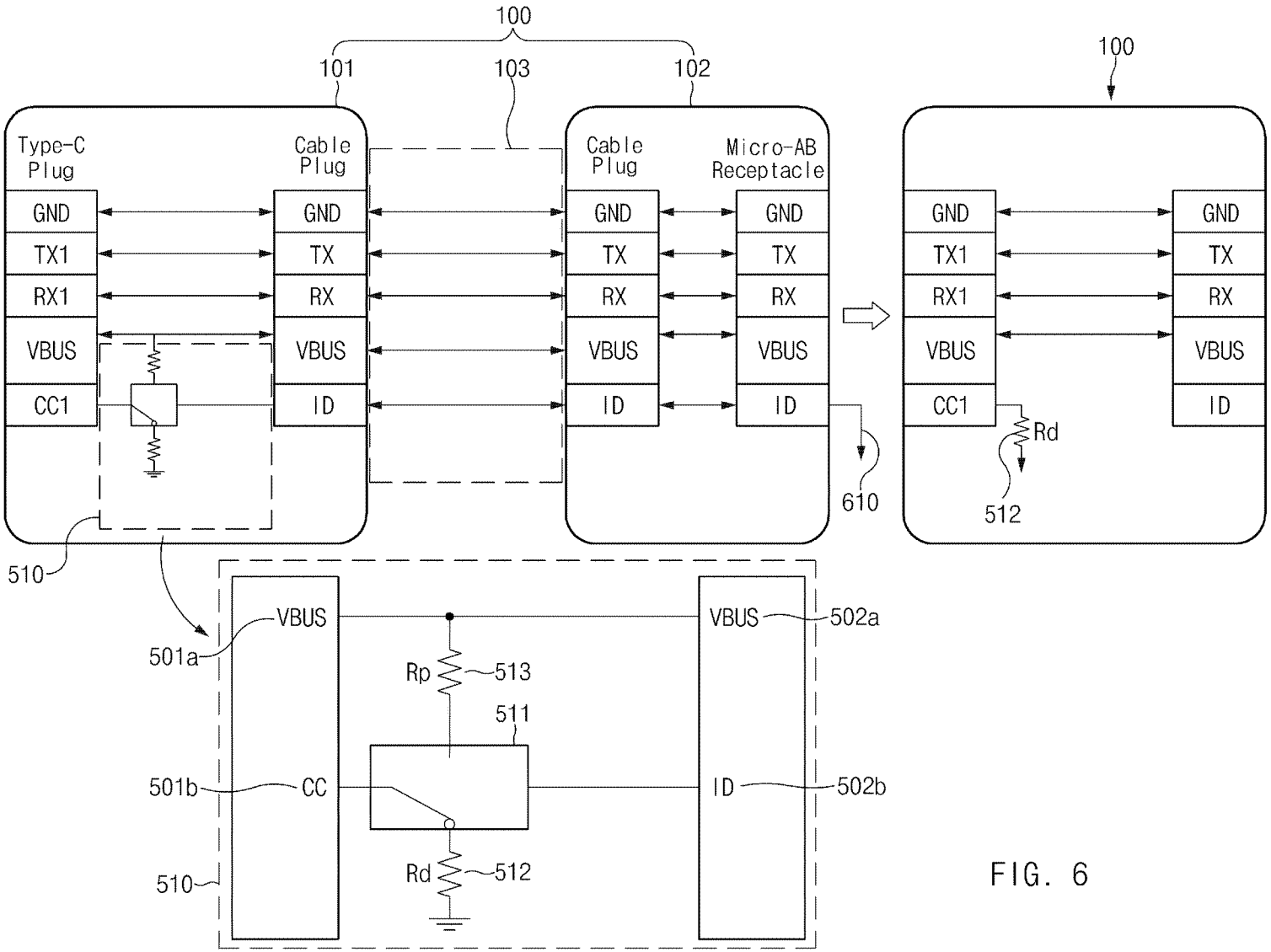
FIG. 6 and FIG. 7 are views illustrating an operation of a switching part according to various embodiments of the present disclosure.
Figure 7:
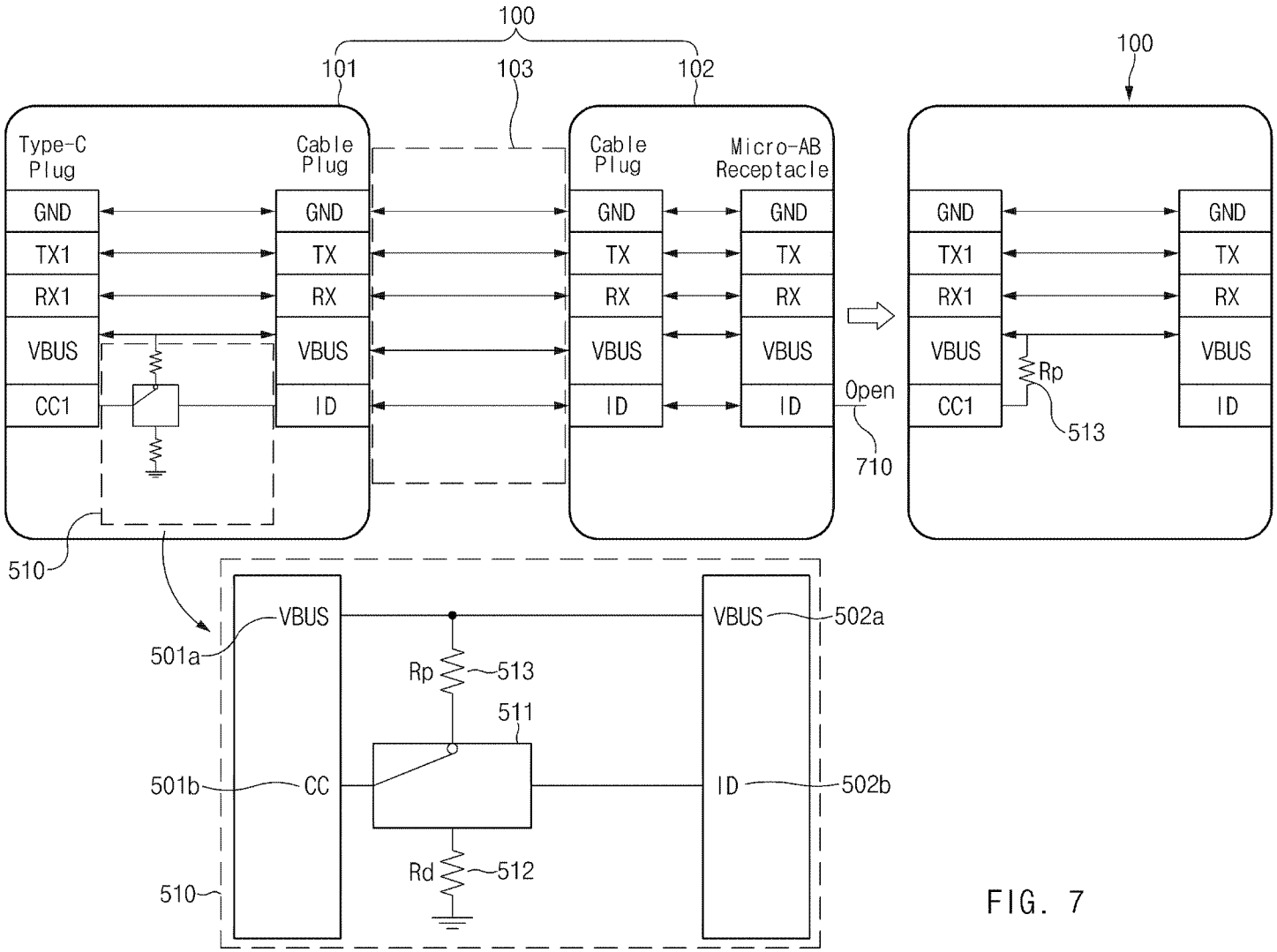

FIGS. 6 and 7 are views for describing an operation of the switching part according to various embodiments of the present disclosure.

Referring now to FIG. 6, the switching part 511 may connect the pull-down resistor (Rd) 512 to the recognition pin (e.g., the CC1 pin) 501*b* if the identification pin (e.g., the ID pin) 502*b* is connected to a ground 610. The recognition pin (e.g., the CC1 pin) 501*b* of the connecting device 100 may be connected to the recognition pin (e.g., the CC1 pin) of the first electronic device 110.

In the case where the first electronic device 110 recognizes the pull-down resistor (Rd) 512 through the recognition pin (e.g., the CC1 pin), the first electronic device 110 may determine that the second electronic device 120 is a 'device mode' device. In this case, the first electronic device 110 may operate in the host mode. The first electronic device 110 may supply electric power to the second electronic device 120 via the connecting device 100 and may read or store data from or in the second electronic device 120.

Referring now to FIG. 7, the switching part 511 may connect the pull-up resistor (Rp) 513 to the recognition pin (e.g., the CC1 pin) 501*b* if the identification pin (e.g., the ID pin) 502*b* remains at an open state. The recognition pin (e.g., the CC1 pin) 501*b* of the connecting device 100 may be connected to the recognition pin (e.g., the CC1 pin) of the first electronic device 110.

In the case where the first electronic device 110 recognizes the pull-up resistor (Rp) 513 through the recognition pin (e.g., the CC1 pin), the first electronic device 110 may determine that the second electronic device 120 is a host mode device. In this case, the first electronic device 110 may operate in the device mode. The first electronic device 110 may be supplied with electric power from the second electronic device 120 and may provide data stored therein to the second electronic device 120.

Figure 8:
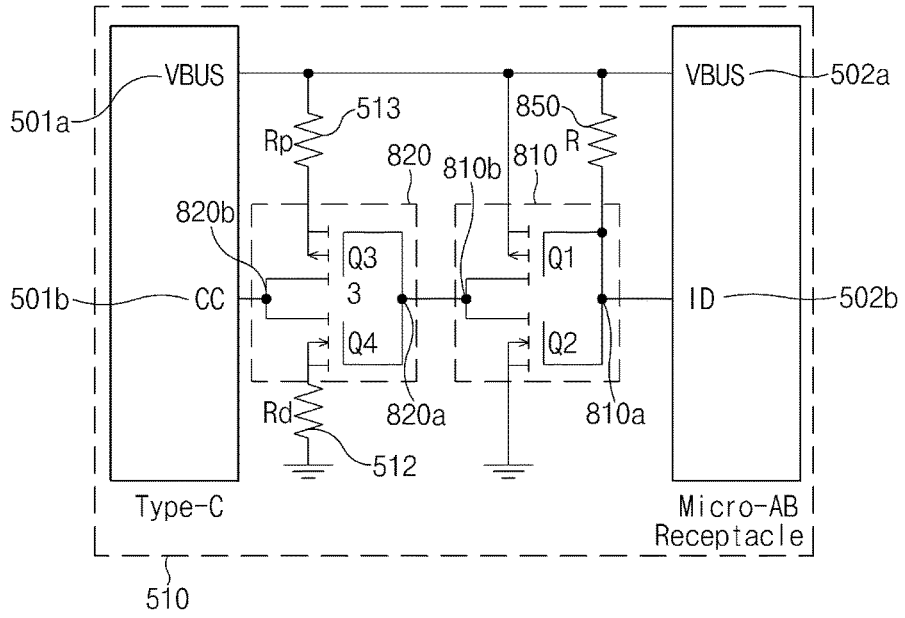
FIG. 8 is a view illustrating a configuration of a switching circuit using a plurality of push-pull circuits, according to various embodiments of the present disclosure.

FIG. 8 is a view illustrating a configuration of the switching circuit using a plurality of push-pull circuits, according to various embodiments. FIG. 8 is only exemplary, not limited thereto.

Referring now to FIG. 8, the switching circuit 510 may include the pull-down resistor (Rd) 512, the pull-up resistor (Rp) 513, a first push-pull circuit 810, a second push-pull circuit 820, and a gate bias resistor 850.

The first push-pull circuit 810 may include a first switch Q1 and a second switch Q2. The first push-pull circuit 810 may be configured such that a drain of the first switch Q1 of a P-channel Metal Oxide Semiconductor Field Effect Transistor (PMOS transistor) and a drain of the second switch Q2 of an N-channel Metal Oxide Semiconductor Field Effect Transistor (NMOS transistor) are connected in series.

An input terminal 810*a* of the first push-pull circuit 810 may be connected to the identification pin 502*b*. An output terminal 810*b* of the first push-pull circuit 810 may be connected to an input terminal 820*a* of the second push-pull circuit 820. A source of the first switch Q1 may be connected to the power pin (VBUS) 502*a*, and a source of the second switch Q2 may be connected to a ground.

According to various embodiments of the present disclosure, the gate bias resistor 850 may be connected between the input terminal 810*a* of the first push-pull circuit 810 and the power pin (VBUS) 502*a*. The gate bias resistor 850 may be a bias resistor for setting an operating voltage of gate terminals of the first and second switches Q1 and Q2.

The second push-pull circuit 820 may include a third switch Q3 and a fourth switch Q4. The second push-pull circuit 820 may be configured such that a drain of the third switch Q3 (PMOS transistor) and a drain of the fourth switch Q4 (NMOS transistor) are connected in series.

An input terminal 820*a* of the second push-pull circuit 820 may be connected to an output terminal 810*b* of the first push-pull circuit 810. An output terminal 820*b* of the second push-pull circuit 820 may be connected to the recognition pin (e.g., the CC1 pin) 501*b*.

A source of the third switch Q3 may be connected to the power pin (VBUS) 501*a* through the pull-up resistor (Rp) 513, and a source of the fourth switch Q4 may be connected to a ground through the pull-down resistor (Rd) 512.

Figure 9A:
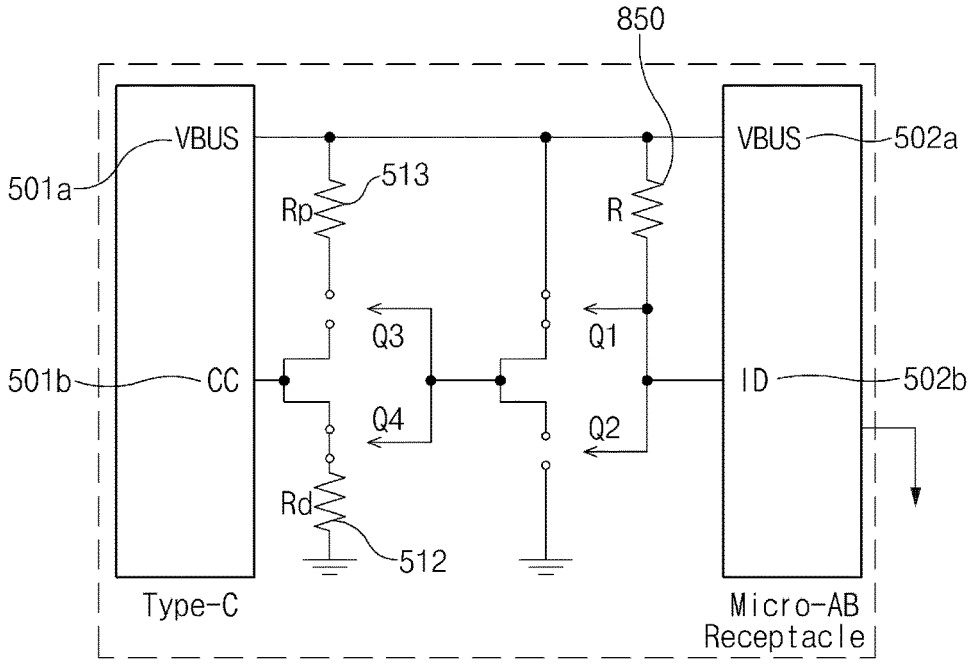
FIG. 9A and FIG. 9B are conceptual diagrams illustrating an operation of a switching circuit of FIG. 8, according to various embodiments of the present disclosure.
Figure 9B:
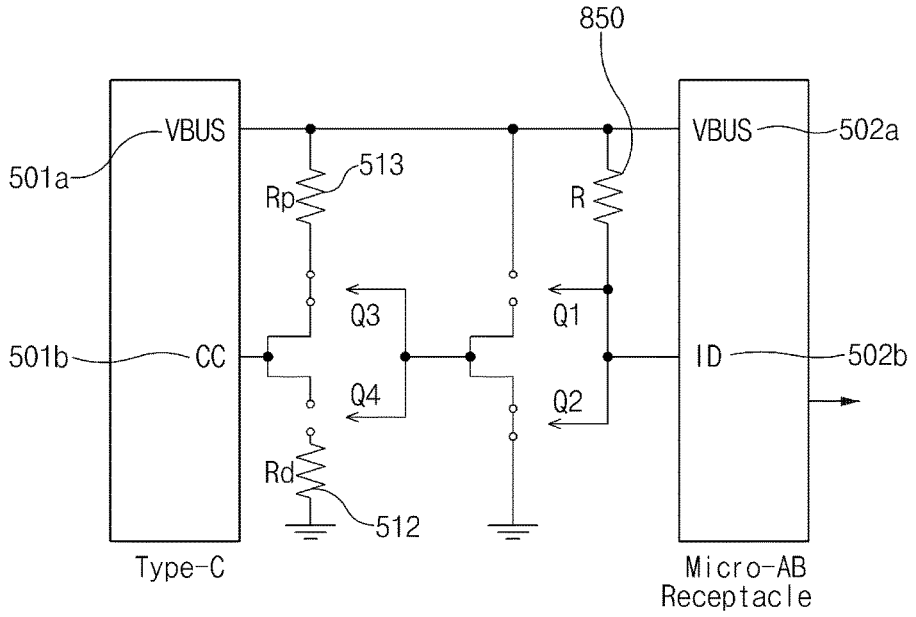

FIGS. 9A and 9B are conceptual diagrams for describing an operation of the switching circuit of FIG. 8, according to various embodiments of the present disclosure.

Referring now to FIG. 9A, in the case where the identification pin (e.g., the ID pin) 502*b* is connected to the ground, the pull-down resistor (Rd) 512 may be connected to the recognition pin (e.g., the CC1 pin) 501*b* through the first push-pull circuit 810 and the second push-pull circuit 820.

If the identification pin (e.g., the ID pin) 502*b* is connected to the ground (if the second electronic device 120 is a device mode device), the first switch Q1 may be turned on, and the second switch Q2 may be turned off. An output terminal 810*b* of the first push-pull circuit 810 may be connected to the power pin (VBUS) 502*a* (high state).

If the output terminal 810*b* of the first push-pull circuit 810 remains at the high state, the input terminal 820*a* of the second push-pull circuit 820 connected to the output terminal 810*b* of the first push-pull circuit 820 may also remain at the high state. In this case, the third switch Q3 may be turned off, and the fourth switch Q4 may be turned on. If the fourth switch Q4 is turned on, the pull-down resistor (Rd) 512 may be connected to the recognition pin (e.g., the CC1 pin) 501*b*.

Referring now to FIG. 9B, in the case where the identification pin (e.g., the ID pin) 502*b* remains at an open state, the pull-up resistor (Rp) 513 may be connected to the recognition pin (e.g., the CC1 pin) 501*b* through the first push-pull circuit 810 and the second push-pull circuit 820.

If the identification pin (e.g., the ID pin) 502*b* remains at an open state (if the second electronic device 120 is a host mode device), the first switch Q1 may be turned off, and the second switch Q2 may be turned on. The output terminal 810*b* of the first push-pull circuit 810 may be connected to the ground (low voltage state).

If the output terminal 810*b* of the first push-pull circuit 810 remains at the low state, the input terminal 820*a* of the second push-pull circuit 820 connected to the output terminal 810*b* of the first push-pull circuit 810 may also remain at the low voltage state. In this case, the third switch Q3 may be turned on, and the fourth switch Q4 may be turned off. If the third switch Q3 is turned on, the pull-up resistor (Rp) 513 may be connected to the recognition pin (e.g., the CC1 pin) 501*b*.

Figure 10:
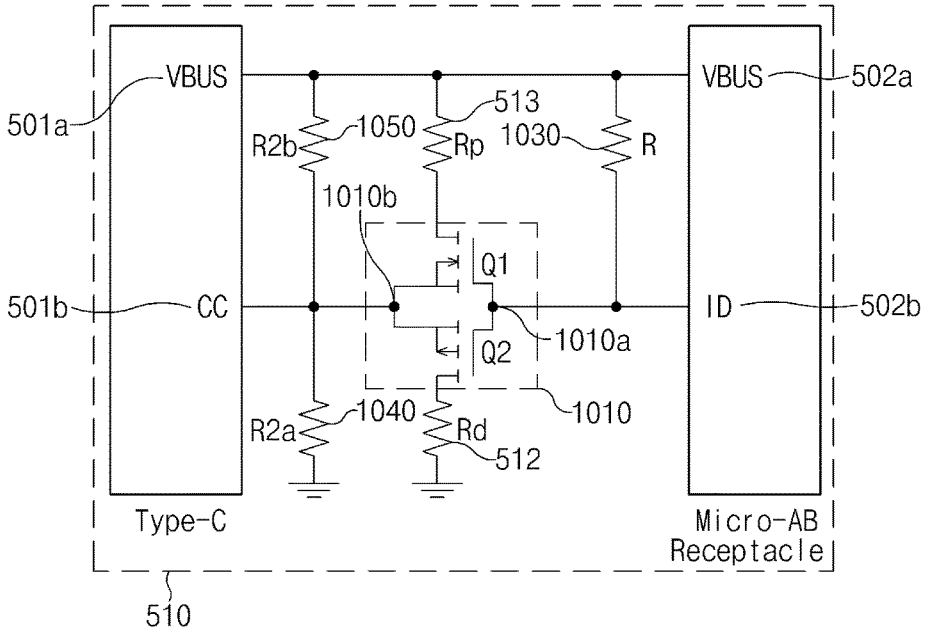
FIG. 10 is a view illustrating a configuration of a switching circuit using one push-pull circuit, according to various embodiments of the present disclosure.

FIG. 10 is a view illustrating a configuration of the switching circuit using one push-pull circuit, according to various embodiments of the present disclosure. FIG. 10 is only exemplary, not limited thereto.

Referring to FIG. 10, the switching circuit 510 may include the pull-down resistor (Rd) 512, the pull-up resistor (Rp) 513, a first push-pull circuit 1010, a gate bias resistor 1030, and source bias resistors 1040 and 1050.

The first push-pull circuit 1010 may include a first switch Q1 and a second switch Q2. The first push-pull circuit 1010 may be configured such that a source of the first switch Q1 (NMOS transistor) and a source of the second switch Q2 (PMOS transistor) are connected in series. An input terminal 1010*a* of the first push-pull circuit 1010 may be connected to the identification pin 502*b*. An output terminal 1010*b* of the first push-pull circuit 1010 may be connected to the recognition pin (e.g., the CC1 pin) 501*b*.

A drain of the first switch Q1 may be connected to the power pin (VBUS) 501*a* through the pull-up resistor (Rp) 513, and a drain of the second switch Q2 may be connected to a ground through the pull-down resistor (Rd) 512.

According to various embodiments of the present disclosure, the gate bias resistor 1030 may be connected between the input terminal 1010*a* of the first push-pull circuit 1010 and the power pin (VBUS) 502*a*. The gate bias resistor 1030 may be a bias resistor for setting an operating voltage of gate terminals of the first and second switches Q1 and Q2.

According to various embodiments of the present disclosure, the source bias resistor 1040 may be connected between the output terminal 1010*b* of the first push-pull circuit 1010 and the ground. The source bias resistor 1050 may be connected between the output terminal 1010*b* of the first push-pull circuit 1010 and the power pin (VBUS) 501*a*. The source bias resistors 1040 and 1050 may be bias resistors for setting an operating voltage of the sources of the first and second switches Q1 and Q2. In various embodiments of the present disclosure, resistance values of the source bias resistors 1040 and 1050 may be greater than those of the pull-down resistor (Rd) 512 and the pull-up resistor (Rp) 513 (the resistance values of the source bias resistors 1040 and 1050 are negligible when the source bias resistor 1040 or 1050 is connected in parallel with the pull-down resistor (Rd) 512 or the pull-up resistor (Rp) 513).

Figure 11A:
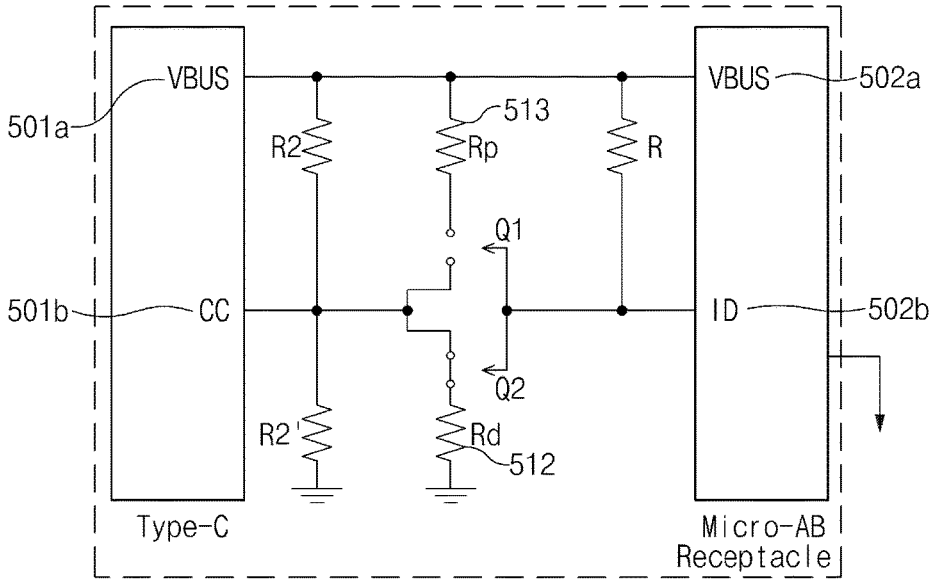
FIG. 11A and FIG. 11B are conceptual diagrams illustrating an operation of the switching circuit of FIG. 10, according to various embodiments of the present disclosure.
Figure 11B:
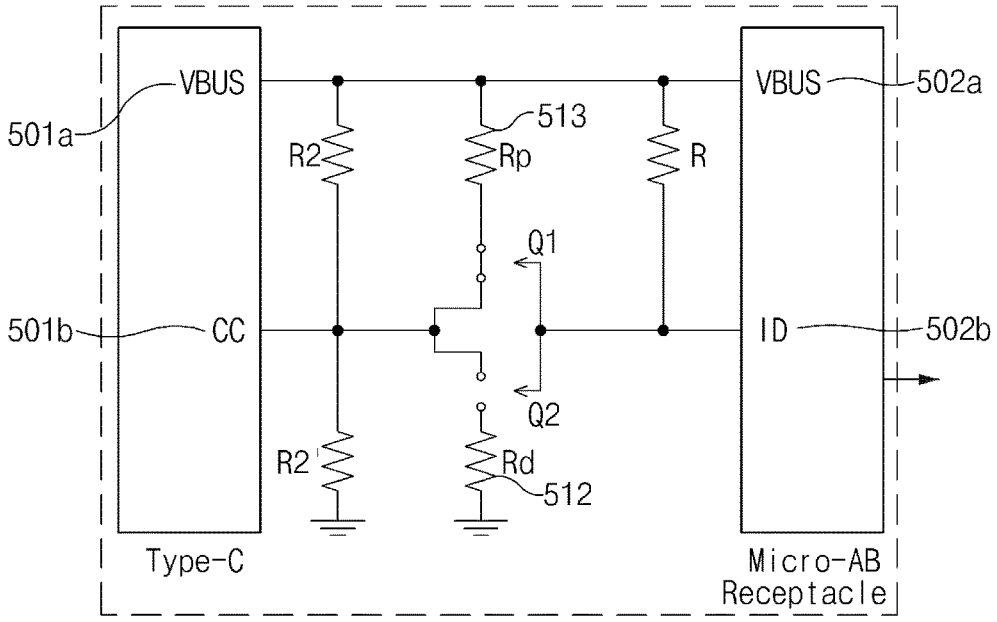

FIGS. 11A and 11B are conceptual diagrams for describing an operation of the switching circuit of FIG. 10, according to various embodiments.

Referring now to FIG. 11A, in the case where the identification pin (e.g., the ID pin) 502*b* is connected to the ground, the pull-down resistor (Rd) 512 may be connected to the recognition pin (e.g., the CC1 pin) 501*b* through the first push-pull circuit 1010.

If the identification pin (e.g., the ID pin) 502*b* is connected to the ground (if the second electronic device 120 is a device mode device), the first switch Q1 may be turned off, and the second switch Q2 may be turned on. If the second switch Q2 is turned on, the pull-down resistor (Rd) 512 may be connected to the recognition pin (e.g., the CC1 pin) 501*b*. Since a resistance value of the source bias resistor 1040 may be greater than that of the pull-down resistor (Rd) 512, the value of resistance may be negligible when the source bias resistor 1040 is connected in parallel with the pull-down resistor (Rd) 512.

Referring to FIG. 11B, in the case where the identification pin (e.g., the ID pin) 502*b* remains at an open state, the pull-up resistor (Rp) 513 may be connected to the recognition pin (e.g., the CC1 pin) 501*b* through the first push-pull circuit 1010.

If the identification pin (e.g., the ID pin) 502*b* remains at an open state (if the second electronic device 120 is a host mode device), the first switch Q1 may be turned on, and the second switch Q2 may be turned off. If the first switch Q1 is turned on, the pull-up resistor (Rp) 513 may be connected to the recognition pin (e.g., the CC1 pin) 501*b*. Since a resistance value of the source bias resistor 1050 is greater than that of the pull-up resistor (Rp) 513, the value may be negligible when the source bias resistor 1040 is connected in parallel with the pull-up resistor (Rp) 513).

Figure 12:
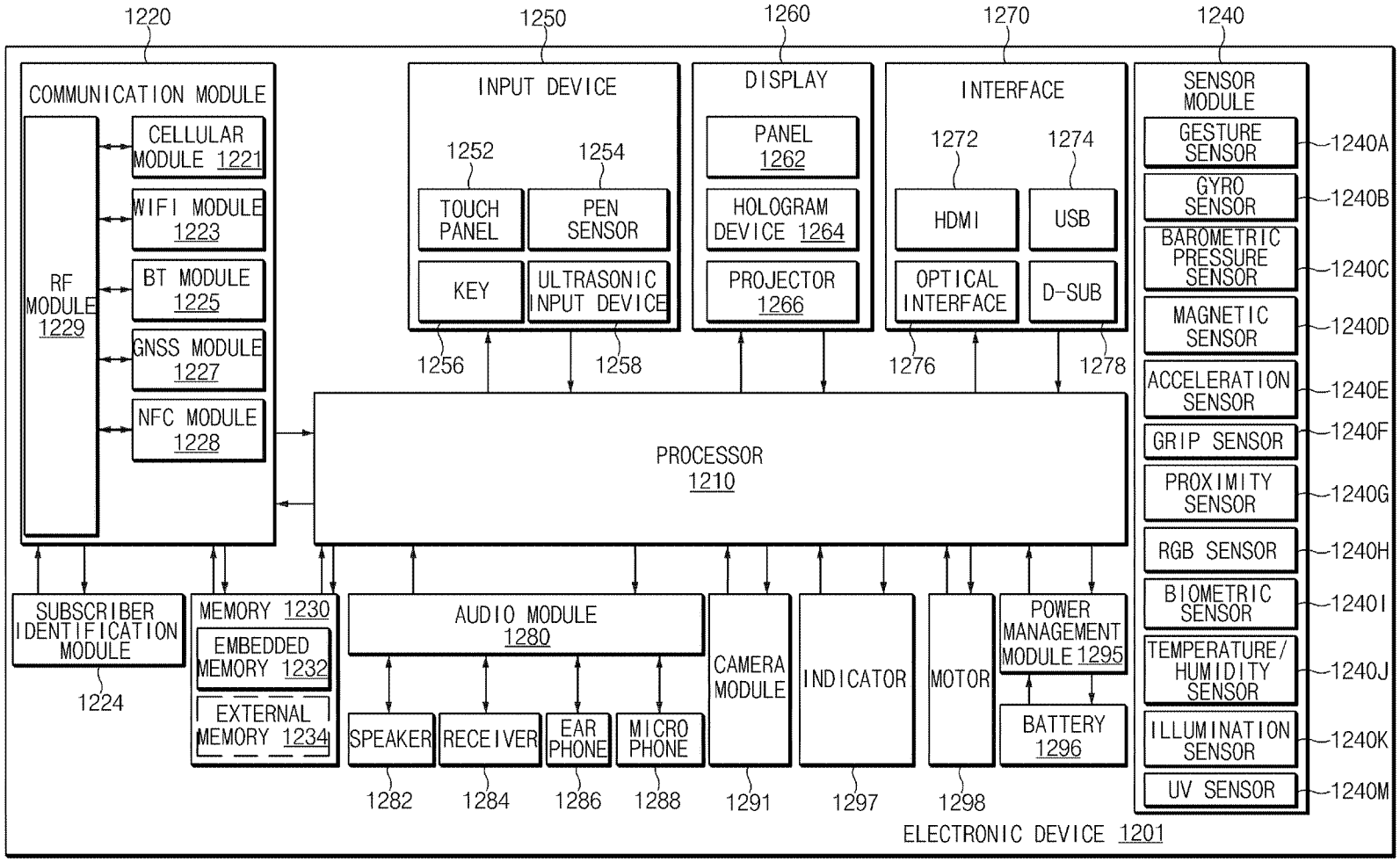
FIG. 12 is a block diagram of an electronic device according to various embodiments of the present disclosure.

FIG. 12 is a block diagram of an electronic device according to various embodiments of the present disclosure. An electronic device 1201 may include, for example, all or a part of the electronic device 121 illustrated in FIG. 1. The electronic device 1201 may include at least one processor (e.g., an application processor (AP)) 1210, a communication module 1220 including hardware such as a transmitter, receiver or transceiver, a subscriber identification module 1224, a non-transitory memory 1230, a sensor module 1240, an input device 1250, a display 1260, an interface 1270, an audio module 1280, a camera module 1291, a power management module 1295, a battery 1296, an indicator 1297, and a motor 1298.

The at least one processor 1210 may drive an operating system (OS) or an application to control a plurality of hardware or software elements connected to the processor 1210 and may process and compute a variety of data. The processor 1210 may be implemented with a System on Chip (SoC), for example. According to an embodiment, the processor 1210 may further include a graphic processing unit (GPU) and/or an image signal processor. The at least one processor 1210 may include at least a part (e.g., a cellular module 1221) of elements illustrated in FIG. 12. The processor 1210 may load and process an instruction or data, which is received from at least one of other elements (e.g., a nonvolatile memory) and may store a variety of data in a nonvolatile memory.

The communication module 1220 may be configured to be the same as or similar to the communication interface 1270 of FIG. 12. The communication module 1220 may include a cellular module 1221, a Wi-Fi module 1223, a Bluetooth (BT) module 1225, a GNSS module 1227 (e.g., a GPS module, a Glonass module, a Beidou module, or a Galileo module), a near field communication (NFC) module 1228, and a radio frequency (RF) module 1229.

The cellular module 1221 may provide voice communication, video communication, a message service, an Internet service or the like through a communication network. According to an embodiment of the present disclosure, the cellular module 1221 may perform discrimination and authentication of the electronic device 1201 within a communication network using the subscriber identification module 1224 (e.g., a SIM card), for example. The cellular module 1221 may perform at least a portion of functions that the processor 1210 provides. In addition, the cellular module 1221 may include a communication processor (CP).

Each of the Wi-Fi module 1223, the BT module 1225, the GNSS module 1227, and the NFC module 1228 may include a processor for processing data exchanged through a corresponding module, for example. According to an embodiment, at least a part (e.g., two or more elements) of the cellular module 1221, the Wi-Fi module 1223, the BT module 1225, the GNSS module 1227, or the NFC module 1228 may be included within one Integrated Circuit (IC) or an IC package.

The RF module 1229 may transmit and receive, for example, a communication signal (e.g., an RF signal). The RF module 1229 may include, for example, a transceiver, a power amplifier module (PAM), a frequency filter, a low noise amplifier (LNA), an antenna, or the like. According to another embodiment, at least one of the cellular module 1221, the Wi-Fi module 1223, the BT module 1225, the GNSS module 1227, or the NFC module 1228 may transmit and receive an RF signal through a separate RF module.

The subscriber identification module 1224 may include, for example, a card and/or embedded SIM that includes a subscriber identification module and may include unique identify information (e.g., integrated circuit card identifier (ICCID)) or subscriber information (e.g., international mobile subscriber identity (IMSI)).

The non-memory 1230 (e.g., the memory 1230) may include an internal memory 1232 or an external memory 1234. For example, the internal memory 1232 may include at least one of a volatile memory (e.g., a dynamic random access memory (DRAM), a static RAM (SRAM), or a synchronous DRAM (SDRAM)), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory, or a NOR flash memory), a hard drive, or a solid state drive (SSD).

With continued reference to FIG. 12, the external memory 1234 may include a flash drive, for example, compact flash (CF), secure digital (SD), micro secure digital (Micro-SD), mini secure digital (Mini-SD), extreme digital (xD), multimedia card (MMC), a memory stick, or the like. The external memory 1234 may be functionally and/or physically connected with the electronic device 1201 through various interfaces.

The sensor module 1240 may measure, for example, a physical quantity or may detect an operation state of the electronic device 1201. The sensor module 1240 may convert the measured or detected information to an electric signal. The sensor module 1240 may include at least one of a gesture sensor 1240A, a gyro sensor 1240B, a barometric pressure sensor 1240C, a magnetic sensor 1240D, an acceleration sensor 1240E, a grip sensor 1240F, a proximity sensor 1240G, a color sensor 1240H (e.g., red, green, blue (RGB) sensor), a biometric sensor 1240I, a temperature/humidity sensor 1240J, an illuminance sensor 1240K, or an UV sensor 1240M. Even though not illustrated, additionally or alternatively, the sensor module 1240 may include, for example, an E-nose sensor, an electromyography sensor (EMG) sensor, an electroencephalogram (EEG) sensor, an electrocardiogram (ECG) sensor, an infrared (IR) sensor, an iris sensor, and/or a fingerprint sensor. The sensor module 1240 may further include a control circuit for controlling at least one or more sensors included therein. According to an embodiment of the present disclosure, the electronic device 1201 may further include at least one processor which is a part of the processor 1210, a sub-processor, or an integrated circuit independent of the processor 1210 and is configured to control the sensor module 1240. The processor comprises circuitry may control the sensor module 1240 while the processor 1210 remains at a sleep state.

The input device 1250 may include, for example, a touch panel 1252, a (digital) pen sensor 1254, a key 1256, or an ultrasonic input unit 1258. The touch panel 1252 may use at least one of capacitive, resistive, infrared and ultrasonic detecting methods. Also, the touch panel 1252 may further include a control circuit. The touch panel 1252 may further include a tactile layer to provide a tactile reaction to a user.

The (digital) pen sensor 1254 may be, for example, a portion of a touch panel or may include an additional sheet for recognition. The key 1256 may include, for example, a physical button, an optical key, a keypad, or the like. The ultrasonic input device 1258 may detect (or sense) an ultrasonic signal, which is generated from an input device, through a microphone (e.g., a microphone 1288) and may check data corresponding to the detected ultrasonic signal.

The display 1260 (e.g., the display 1260) may include a panel 1262, a hologram device 1264, or a projector 1266. The panel 1262 may be configured the same as or similar to the display 1260 of FIG. 12. The panel 1262 may be implemented to be flexible, transparent or wearable, for example. The panel 1262 and the touch panel 1252 may be integrated into a single module. The hologram device 1264 may display a stereoscopic image in a space using a light interference phenomenon. The projector 1266 may project light onto a screen so as to display an image. The screen may be arranged inside or outside the electronic device 1201. According to an embodiment of the present disclosure, the display 1260 may further include a control circuit for controlling the panel 1262, the hologram device 1264, or the projector 1266.

The interface 1270 may include, for example, a high-definition multimedia interface (HDMI) 1272, a universal serial bus (USB) 1274, an optical interface 1276, or a D-subminiature (D-sub) 1278. The interface 1270 may be included, for example, in the communication interface illustrated in FIG. 12. Additionally or alternatively, the interface 1270 may include, for example, a mobile high definition link (MHL) interface, a SD card/multi-media card (MMC) interface, or an infrared data association (IrDA) standard interface.

The audio module 1280 includes hardware such as an integrated circuit in order to convert between a sound and an electrical signal, and vice versa. At least a part of the audio module 1280 may be included, for example, in the input/output interface 1270 illustrated in FIG. 12. The audio module 1280 may process, for example, sound information that is input or output through a speaker 1282, a receiver 1284, an earphone 1286, or a microphone 1288.

The camera module 1291 for shooting a still image or a video may include, for example, at least one image sensor (e.g., a front sensor or a rear sensor), a lens, an image signal processor (ISP), or a flash (e.g., an LED or a xenon lamp).

The power management module 1295 may manage, for example, power of the electronic device 1201. According to an embodiment of the present disclosure, a power management integrated circuit (PMIC) a charger IC, or a battery or fuel gauge may be included in the power management module 1295. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, a rectifier, or the like. The battery gauge may measure, for example, a remaining capacity of the battery 1296 and a voltage, current or temperature thereof while the battery is charged. The battery 1296 may include, for example, a rechargeable battery or a solar battery.

With continued reference to FIG. 12, the indicator 1297 may display a specific state of the electronic device 1201 or a part thereof (e.g., the processor 1210), such as a booting state, a message state, a charging state, and the like. The motor 1298 may convert an electrical signal into a mechanical vibration and may generate a vibration effect, a haptic effect, or the like. Even though not illustrated, a graphics processing device (e.g., a GPU) for supporting a mobile TV may be included in the electronic device 1201. The processing device for supporting a mobile TV may process media data according to the standards of digital multimedia broadcasting (DMB), digital video broadcasting (DVB), MediaFlo™, or the like.

Each of the above-mentioned elements may be configured with one or more components, and the names of the elements may be changed according to the type of the electronic device. The electronic device according to various embodiments of the present disclosure may include at least one of the above-mentioned elements, and some elements may be omitted or other additional elements may be added. Furthermore, some of the elements of the electronic device according to various embodiments of the present disclosure may be combined with each other so as to form one entity, so that the functions of the elements may be performed in the same manner as before the combination.

According to various embodiments of the present disclosure, a connecting device includes a first connector corresponding to a first type of connection configuration of a first external electronic device, a second connector corresponding to a second type of connection configuration of a second external electronic device, a plurality signal lines connecting some (at least a portion) of a row of pins included in the first connector to at least a portion of a row of pins included in the second connector and a switching circuit connected to a recognition pin of the first connector, wherein the switching circuit connects one of a first resistor and a second resistor to the recognition pin included in the first connector according to a control of an identification (ID) pin included in the second connector.

According to various embodiments of the present disclosure, the first connector may be connected to a first type connector mounted on a first external electronic device, and the second connector may be connected to a second type connector mounted on a second external electronic device.

According to various embodiments of the present disclosure, the first connector may be corresponds to USB Type-C, and the second connector may be corresponds to one of USB Type-A, USB Type-B, USB Type mini-A, USB Type mini-B, USB Type micro-A, and USB Type micro-B.] The connecting device of the present disclosure is not limited to the Universal Serial Bus configurations.

According to various embodiments of the present disclosure, the first resistor may be a pull-down resistor arranged between the recognition pin and a ground. The second resistor may be a pull-up resistor arranged between a power pin of the first connector and the recognition pin.

According to various embodiments of the present disclosure, a power pin of the first connector may apply a voltage to a power pin of the second connector if the first resistor may be connected to the recognition pin. The power pin of the first connector may be supplied with a voltage by a second external device via a power pin of the second connector if the second resistor is connected to the recognition pin through the switching circuit.

According to various embodiments of the present disclosure, the recognition pin may be a channel configuration (CC) pin according to a USB 3.1 standard, and the ID pin is an ID pin according to a USB 2.0 or 3.0 standard.

According to various embodiments of the present disclosure, the switching circuit may comprise first and second push-pull circuits, wherein the first push-pull circuit is serially connected between a power pin of the second connector and a ground, and wherein the second push-pull circuit is serially connected between the first resistor and the second resistor. An input terminal of the first push-pull circuit may be connected to the ID pin and an output terminal thereof is connected to an input terminal of the second push-pull circuit, and an output terminal of the second push-pull circuit may be connected to the recognition pin. The first push-pull circuit is controlled by the recognition pin, and the second push-pull circuit is controlled by an output terminal of the first push-pull circuit. The switching circuit further includes a gate bias resistor connected between the power pin of the second connector and the ID pin.

According to various embodiments of the present disclosure, the first push-pull circuit may be configured such that a drain of a first switch implemented with a (PMOS) transistor and a drain of a second switch implemented with an NMOS transistor are connected in series, and the second push-pull circuit may be configured such that a drain of a third switch implemented with a PMOS transistor and a drain of a fourth switch implemented with an NMOS transistor are connected in series. If the ID pin is connected to a ground, the first switch and the fourth switch are turned on such that the first resistor is connected to the recognition pin. If the ID pin remains at an open state, the second switch and the third switch are turned on to connect the second resistor to the recognition pin.

According to various embodiments of the present disclosure, the switching circuit comprises a push-pull circuit, wherein the push-pull circuit is serially connected between the first resistor and the second resistor, and wherein an input terminal of the push-pull circuit is connected to the ID pin and an output terminal thereof is connected to the recognition pin. The switching circuit further includes a gate bias resistor connected between a power pin of the second connector and the ID pin, a first source bias resistor connected between the output terminal of the push-pull circuit and a ground; and a second source bias resistor connected between the output terminal of the push-pull circuit and a power pin of the first connector.

According to various embodiments of the present disclosure, the push-pull circuit is configured such that a source of a first switch implemented with an NMOS transistor and a source of a second switch implemented with a PMOS transistor are connected in series. If the ID pin is connected to a ground, the second switch is turned to connect electrically the first resistor to the recognition pin. If the ID pin remains in an open state, the first switch is turned to connect electrically the second resistor to the recognition pin.

A connecting device according to various embodiments of the present disclosure may allow a connection of an electronic device of an on-the-go (OTG) type, which is capable of operating both a host mode and a device mode, to be connected with both a host mode device and a device mode device.

The connecting device according to various embodiments of the present disclosure may connect electronic devices that support various universal serial bus (USB) types, in forms corresponding to the types thereof.

The apparatuses and methods of the disclosure can be implemented in hardware, and in part as firmware or via the execution of software or computer code in conjunction with hardware that is stored on a non-transitory machine readable medium such as a CD ROM, a RAM, a floppy disk, a hard disk, or a magneto-optical disk, or computer code downloaded over a network originally stored on a remote recording medium or a non-transitory machine readable medium and stored on a local non-transitory recording medium for execution by hardware such as by at least one processor, so that the methods described herein are loaded into hardware such as a general purpose computer, or a special processor or in programmable or dedicated hardware, such as an ASIC or FPGA.

As would be understood in the art, the computer, the processor, microprocessor, controller, control unit or the programmable hardware include memory components, e.g., RAM, ROM, Flash, etc., that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

In addition, an artisan understands and appreciates that a "processor", "microprocessor" "controller", or "control unit" constitute hardware in the claimed disclosure that contain circuitry, such as integrated circuitry, that is configured for operation. The control unit/controller may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc.

Under the broadest reasonable interpretation, the appended claims constitute statutory subject matter in compliance with 35 U.S.C. § 101 and none of the elements are software per se.

Nor are the claims directed to Abstract ideas, and constitute statutory subject matter under 35 U.S.C. § 101.

The definition of the terms "unit" or "module" as referred to herein are to be understood as constituting hardware circuitry such as a CCD, CMOS, SoC, AISC, FPGA, at least one processor or microprocessor (e.g. a controller or control unit) configured for a certain desired functionality, or a communication module containing hardware such as transmitter, receiver or transceiver, or a non-transitory medium comprising machine executable code that is loaded into and executed by hardware for operation, in accordance with statutory subject matter under 35 U.S.C. § 101 and do not constitute software per se.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A connecting device comprising:

a first connector corresponding to a first type of connection configuration of a first external electronic device;

a second connector corresponding to a second type of connection configuration of a second external electronic device, in which the first type of connection configuration is different from the second type of connection configuration;

a plurality of signal lines connecting at least a portion of a row of pins included in the first connector to at least a portion of a row of pins included in the second connector; and a switching circuit connected to a recognition pin of the first connector, wherein the switching circuit electrically connects one of a first resistor and a second resistor to the recognition pin included in the first connector according to a control of an identification (ID) pin included in the second connector, wherein the switching circuit comprises a first push-pull circuit and a second push-pull circuit, wherein the first push-pull circuit is serially connected between a power pin of the second connector and a ground, and wherein the second push-pull circuit is electrically connected in series between the first resistor and the second resistor.

2. The connecting device of claim 1, wherein the first connector is connected to a first type connector mounted on the first external electronic device, and wherein the second connector is connected to a second type connector mounted on the second external electronic device.

3. The connecting device of claim 1, wherein the first resistor comprises a pull-down resistor electrically connected between the recognition pin and a ground.

4. The connecting device of claim 1, wherein the second resistor comprises a pull-up resistor electrically connected between a power pin of the first connector and the recognition pin.

5. The connecting device of claim 1, wherein a power pin of the first connector applies a voltage received from the first external electronic device to a power pin of the second connector of the second external electronic device when the first resistor is connected to the recognition pin.

6. The connecting device of claim 1, wherein a power pin of the first connector is supplied with a voltage received from the second external electronic device via a power pin of the second connector when the second resistor is connected to the recognition pin through the switching circuit.

7. The connecting device of claim 1, wherein the recognition pin comprises a channel configuration (CC) pin according to a USB 3.1 standard, and wherein the ID pin is configured according to a USB 2.0 or 3.0 standard.

8. The connecting device of claim 1, wherein an input terminal of the first push-pull circuit is electrically connected to the ID pin and an output terminal thereof is electrically connected to an input terminal of the second push-pull circuit, and wherein an output terminal of the second push-pull circuit is electrically connected to the recognition pin.

9. The connecting device of claim 1, wherein the first push-pull circuit is controlled by the recognition pin, and wherein the second push-pull circuit is controlled by an output terminal of the first push-pull circuit.

10. The connecting device of claim 1, wherein the switching circuit further comprises:

a gate bias resistor electrically connecting the power pin of the second connector to the ID pin.

11. The connecting device of claim 1, wherein the first push-pull circuit is configured such that a drain of a first switch of a PMOS transistor and a drain of a second switch of an NMOS transistor are electrically connected in series, and wherein the second push-pull circuit is configured such that a drain of a third switch of the PMOS transistor and a drain of a fourth switch of the NMOS transistor are electrically connected in series.

12. The connecting device of claim 11, wherein when the ID pin is connected to a ground, the first switch and the fourth switch are turned on to connect electrically the first resistor to the recognition pin.

13. The connecting device of claim 11, wherein in response to the ID pin being in an open state, the second switch and the third switch are turned on to electrically connect the second resistor to the recognition pin.

14. A connecting device comprising:

a first connector corresponding to a first type of connection configuration of a first external electronic device;

a second connector corresponding to a second type of connection configuration of a second external electronic device, in which the first type of connection configuration is different from the second type of connection configuration;

a plurality of signal lines connecting at least a portion of a row of pins included in the first connector to at least a portion of a row of pins included in the second connector; and a switching circuit connected to a recognition pin of the first connector, wherein the switching circuit electrically connects one of a first resistor and a second resistor to the recognition pin included in the first connector according to a control of an identification (ID) pin included in the second connector, wherein the switching circuit comprises a push-pull circuit, wherein the push-pull circuit is electrically connected in series between the first resistor and the second resistor, and wherein an input terminal of the push-pull circuit is connected to the ID pin and an output terminal thereof is connected to the recognition pin.

15. The connecting device of claim 14, wherein the switching circuit further comprises:

a gate bias resistor electrically connected between a power pin of the second connector and the ID pin;

a first source bias resistor electrically connected between the output terminal of the push-pull circuit and a ground; and a second source bias resistor electrically connected between the output terminal of the push-pull circuit and a power pin of the first connector.

16. The connecting device of claim 14, wherein the push-pull circuit is configured such that a source of a first switch comprising an NMOS transistor and a source of a second switch comprising a PMOS transistor are electrically connected in series.

17. The connecting device of claim 16, wherein in response to the ID pin being electrically connected to a ground, the second switch is turned to connect the first resistor to the recognition pin.

18. The connecting device of claim 16, wherein in response to the ID pin being in an open state, the first switch is turned to electrically connect the second resistor to the recognition pin.

19. A method of connecting a first external electronic device to a second external electronic device by a connecting device, the method comprising:

providing the connecting device having a first connector corresponding to a first type of connection configuration of a first external electronic device, and a second connector corresponding to a second type of connection configuration of a second external electronic device, connecting at least a portion of a row of pins included in the first connector to at least a portion of a row of pins included in the second connector by a plurality of signal lines, providing a switching circuit that connects one of a first resistor and a second resistor to a recognition pin included in the first connector according to a control of an identification (ID) pin included in the second connector, wherein the first type of connection configuration is different from the second type of connection configuration, wherein the switching circuit comprises a first push-pull circuit and a second push-pull circuit, wherein the first push-pull circuit is serially connected between a power pin of the second connector and a ground, and wherein the second push-pull circuit is electrically connected in series between the first resistor and the second resistor.

* * * * *